United States Patent [19]

Ritschel

[11] 4,298,303

[45] Nov. 3, 1981

[54] DEVICE FOR TRANSPORTING AND STORING SPOOLS AND PARTICULARLY YARN SPOOLS

[75] Inventor: Josef Ritschel, Freiburg, Fed. Rep. of Germany

[73] Assignee: Rhodia AG, Freiburg im Breisgau, Fed. Rep. of Germany

[21] Appl. No.: 72,629

[22] Filed: Sep. 5, 1979

[30] Foreign Application Priority Data

Sep. 9, 1978 [DE] Fed. Rep. of Germany ..... 2839296

[51] Int. Cl.[3] ..... B65G 67/00

[52] U.S. Cl. ..... 414/401; 414/395; 414/396

[58] Field of Search ..... 414/401, 340, 345, 352, 414/373, 390, 395, 396, 572, 498, 446

[56] References Cited

U.S. PATENT DOCUMENTS

| | | | |
|---|---|---|---|
| 3,186,566 | 6/1965 | Spinanger et al. | 414/395 |
| 3,295,881 | 1/1967 | Worthington | 414/352 |
| 3,721,354 | 3/1973 | Raynes et al. | 414/396 |
| 4,127,856 | 11/1978 | Bickel | 414/401 |
| 4,199,290 | 4/1980 | Jacoby | 414/401 |

*Primary Examiner*—Trygve M. Blix
*Assistant Examiner*—L. E. Williams
*Attorney, Agent, or Firm*—Bucknam and Archer

[57] ABSTRACT

A device for the take-up, storage and transportation of spools, particularly yarn spools, is described, which comprises a spool carriage which consists of a subframe and a spool rack, the subframe and the spool rack being connectable together and separable from each other, the spool rack being similarly connectable to a pallet and being separable from the pallet. A coupling pallet element is provided to engage with the subframe.

8 Claims, 2 Drawing Figures

DEVICE FOR TRANSPORTING AND STORING SPOOLS AND PARTICULARLY YARN SPOOLS

Figure 1:
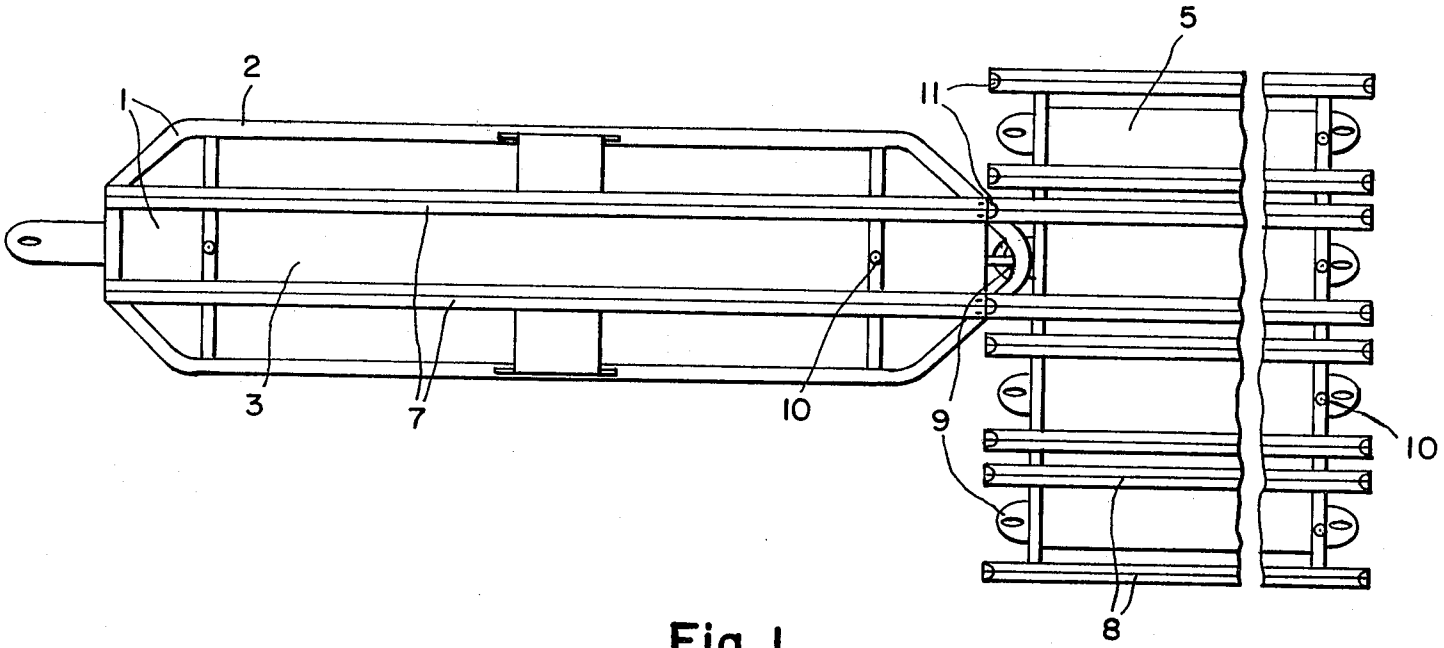

The invention relates to a device for transporting and storing spools, and more specifically to a device for transporting and storing yarn spools with minimum space requirement.

Many devices are known for the take-up, storage and transportation of yarn spools within an industrial plant as well as between the manufacturing and the processing installations.

For the take-up, movement and storage of yarn spools in the manufacturing installations spool carriages are used, for example according to the Bulletin of the company Zarges, Weilheim, No. 177 of Nov. 11, 1974, page 2, entitled "Transportwagen W 185", for transporting the yarn spools in the packing department, to processing installations, from the spool carriages to shipping containers.

Frequently spool carriages are by-passed in the spool manufacture as well as the spool processing plant and the yarn spools are placed directly into shipping containers at the spooling machine, so that the travel and storage within the plants and the transportation of the spools between the installations occurs in the shipping containers.

The take-up, travel, storage and transportation of yarn spools to processing installations exclusively with spool carriages and without any further transfer of the yarn spools is carried out in a different manner. In this case the yarn spools are placed on spool carriages at the spooling machine, are moved and stored in the production installation on these carriages and in this manner are conveyed to the processing plant ready at the processing machine.

Substantial drawbacks accompany the use of the spool conveying devices discussed hereinabove. They are the relatively great manual work in transferring the yarn spools into and out of the shipping containers as well as the danger of yarn damage. Furthermore, the use of shipping containers, which are usually one-way units, greatly increases the cost of transportation and storage of the yarn spools. When spool carriages are used exclusively, that is when the spool transportation to the processing plant also occurs on the carriages, which are intended for use within the plant, the expenditure per yarn unit for loading the transport vehicles and especially the transport space requirement are greatly increased over spool shipping in shipping containers.

One object of the present invention is to provide a device which avoids the disadvantages discussed hereinabove and which permits the storage and transportation of spools, and particularly yarn spools, with minimum space requirement.

The device for the take-up, storage and transportation of yarn spools according to the present invention comprises a spool carriage and a pallet. The spool carriage consists of a subframe and spool rack which may be connected together or may be separated from each other. The spool rack may be connected to the pallet or may be separated from it. In the same manner the pallet is adjusted to the subframe and may be coupled with it and the pallet is adapted for the take-up of several spool racks.

According to one embodiment of the invention, the spool rack is provided with means for moving the rack, means for holding and guiding the moving means, which holding and guiding means are placed in the subframe or in the pallet.

According to a specific embodiment of the invention the device comprises means for stopping the motion placed at the subframe and at the pallet; which stopping means are in the region of the guiding and holding means. According to another specific embodiment of the invention, the device comprises coupling means located at the ends of the guiding and holding means for coupling the pallet to the subframe.

According to a further specific embodiment of the invention, the device comprises at the ends of the guiding and holding means guides which are adapted to fit the front face of the subframe.

The combination of such a subdivided and detachably coupled spool carriage with the cooperating pallet, on which are disposed several guiding and holding elements for spool racks, permits, after transportation of the yarn spools by means of detachably coupled spool carriages into storage, the transfer of the spool racks from several subframes onto a pallet. The transfer of the spool racks to the pallet is effected by pushing over or sliding, a detachable coupling being entered into also by engagement of the spool rack moving structures, for instance rollers, with the pallet guiding and holding elements. In the end position of the spool racks on the pallet, as on the subframe, stopping means against undesired displacement of the spool racks become operative. The transfer of the pallet containing several spool racks connected with it, to long-distance transport vehicles, takes place with the use of fork lifts.

Figure 2:
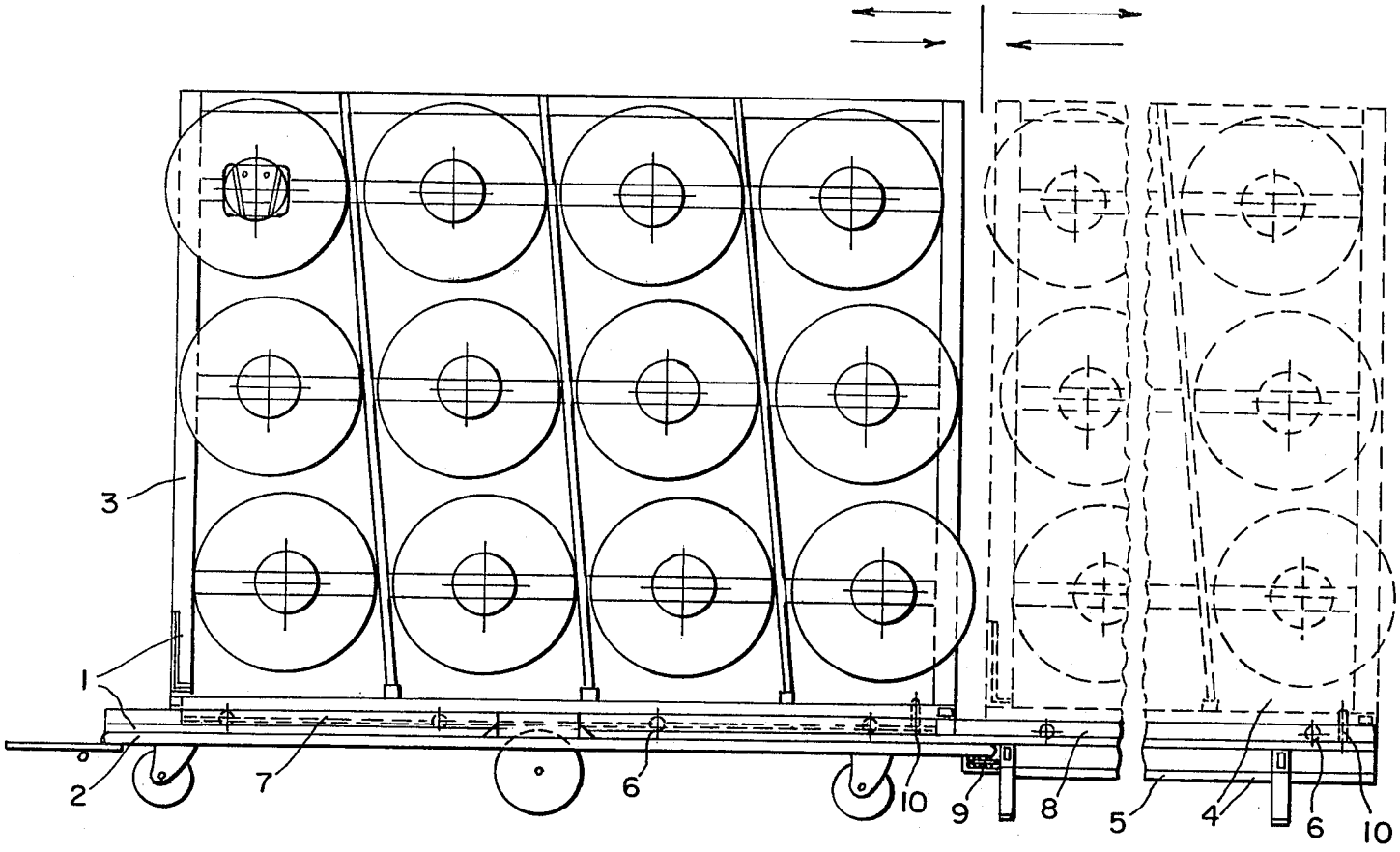

The invention will be further illustrated by reference to the accompanying drawing of which FIG. 1 is a top plan view of the device and FIG. 2 is a side elevational view.

Numeral 1 designates the spool carriage which is divided into a subframe 2 and spool rack 3, preferably in sliding engagement. For example, four spool racks 3, taken over from subframes 2 onto a pallet 5 and also maintained in sliding engagement, form a shipping unit 4.

Several small rollers 6 are mounted on one side; at the frame base of spool rack 3, preferably externally along the length. These rollers 6 take over on the parts of the spool rack 3 the essential function of carrying the spool rack 3, its rolling from subframe 2 to pallet 5 or back, and of achieving engagement with the guiding and holding elements 7, 8 of subframe 2 and/or pallet 5.

The frame of subframe 2 carries advantageously on its top side a firmly connected rail pair 7 in the spacing of the two rows of rollers 6 of the spool rack 3. These rail pairs extend parallel and horizontal over the entire axial length of the spool carriage 3 and are open at the ends. The rails 7 are laterally slotted over the entire length for passage of the roller axles of spool rack 3. This arrangement results in the reaction of the rollers 6 of spool rack 3 and permits an advantageous sliding connection of spool rack 3 with subframes 2. The rails 7 impart to the spool rack the necessary lateral and vertical guiding through the rollers 6.

Advantageously pallet 5 carries on its surface, at the same level as subframe 2, four firmly connected rail pairs 8 close together extending parallel and horizontal over their entire length and open at the ends. Also these rails are slotted laterally over the full length for passage of the roller axles of spool rack 3.

The result of this arrangement is that the same sliding connection as between spool rack 3 and subframe 2 is achieved. This arrangement permits at equal level the transfer of four spool racks 3 onto one pallet 5 and leads to a storage and transportation device for yarn spools 3 with minimum space requirement.

At the subframe 2 as well as at the pallet 5 there are disposed at both end faces, in the case of pallet 5 for each rail pair 8, carriage couplings 9 automatically coupling at the center. A spool carriage 1 is held together with a pallet 5 by means of these couplings 9 during the transfer of a spool rack 3, so that running away of the subframe 2 and as a result the rolling off of the spool rack 3 are prevented.

Subframe 2 as well as pallet 5 carry in the region of each rail pair 7, 8, a spring-supported fixing bolt 10, which in the end position of each spool rack 3 automatically engages in a cut-out of its frame base. In this manner, any undesired displacement of the spool racks becomes impossible.

Finally, there are present at pallet 5, at both ends of each rail pair 8, guide elements 11 which are adapted to the end faces of the subframe. These guide elements 11 are firmly connected with the front end of the subframe. Preferably the guide elements are made convex and are intended to engage with the concave bight formed by the guide elements of the pallet. The guide elements of the subframe mate with the guide elements of the pallet against which they are pushed for accurate fitting with alignment of the rails of the subframe and the pallet. The connection between the guide elements and the subframe may be made for instance by welding, by means of screws, rivets or similar means. Obviously the opposite construction could be used with the guide elements 11 being concave and the guide elements on the pallet being convex. This design facilitates, when the spool carriage 1 is brough to pallet 5, the alignment of rails 7 and 8 of subframe 2 and pallet 5 as well as the engagement of the coupling 9, both of which are the prerequisites for easy and safe transfer of the spool rack 3 from the subframe 2 to the pallet 5 or vice versa.

The spool transport device according to the invention, by the use of a spool carriage subdivided into a subframe and a spool rack, in connection with the aligned pallet, makes possible for several spool racks with yarn spools to be transported and stored with a minimum of volume, in a simple manner and with low manual labor, while eliminating one-way packing containers.

Although the figures show yarn spools of circular cross section, the device of the present invention is also applicable to yarn spools of different cross section, for instance triangular, square, etc.

What is claimed is:

1. A device for the take-up, storage and transportation of spools, particularly yarn spools, which comprises:

(a) a spool carriage (1) which consists of a subframe (2) and a spool rack (3), the subframe and the spool rack being connectable together and separable from each other;

(b) said spool rack being similarly connectable to a pallet (5) and being separable therefrom in the same manner;

(c) the pallet being engageable with the subframe (9) means for coupling said pallet to said subframe (9);

(d) the pallet being capable of take-up of several spool racks;

(e) coupling means between said spool carriage and said pallet.

2. The device according to claim 1, wherein first moving means are provided for moving said spool rack, and first guiding and holding means are provided in the subframe for receiving said first moving means.

3. The device according to claim 2 wherein second moving means are provided for moving said spool rack and second guiding and holding means are provided in the pallet for receiving said second moving means.

4. The device according to claim 3 wherein a stopping device is provided in the region of said first and second guiding and holding means at the subframe and at the pallet.

5. The device according to claim 4 which is provided with coupling means between said spool carriage and said pallet at the end of said first and second guiding and holding means.

6. The device according to claim 1 wherein the pallet comprises at the end of the second guiding and holding means guides which are adapted to the end face of the subframe.

7. The device according to claim 1 wherein the yarn spools are of circular cross section.

8. The device according to claim 6 wherein said guides are convex and engage with the concave bight formed by the guide elements of the pallet.

* * * * *